US011336982B1

(12) United States Patent
Venkatakrishnan et al.

(10) Patent No.: US 11,336,982 B1
(45) Date of Patent: May 17, 2022

(54) HEARING DEVICE SEAL MODULES, MODULAR HEARING DEVICES INCLUDING THE SAME AND ASSOCIATED METHODS

(71) Applicant: Sonova AG, Stäfa (CH)

(72) Inventors: Yashvant Venkatakrishnan, San Jose, CA (US); Xiuming Zhu, San Jose, CA (US); Michael Au, Union City, CA (US); Frank Wang, San Bruno, CA (US); Grace Gardner, San Leandro, CA (US); Marius Ruefenacht, Mountain View, CA (US); Barjinder Chana, Dublin, CA (US); Erdal Karamuk

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/134,290

(22) Filed: Dec. 26, 2020

(51) Int. Cl.
*H04R 25/00* (2006.01)
*H04R 1/10* (2006.01)

(52) U.S. Cl.
CPC ..... *H04R 1/1016* (2013.01); *H04R 25/656* (2013.01); *H04R 25/658* (2013.01)

(58) Field of Classification Search
CPC ..... H04R 25/60; H04R 25/658; H04R 2225/023; H04R 2460/17
See application file for complete search history.

(56) References Cited

U.S. PATENT DOCUMENTS 4,870,688 A * 9/1989 Voroba ..... H04R 25/609 381/60
4,880,076 A 11/1989 Ahlberg et al.
5,002,151 A 3/1991 Oliveira et al.
6,129,174 A 10/2000 Brown et al.
6,940,988 B1 * 9/2005 Shennib ..... H04R 25/60 381/322
7,215,789 B2 * 5/2007 Shennib ..... H04R 25/456 381/328
7,580,537 B2 * 8/2009 Urso ..... H04R 25/652 381/322
7,664,282 B2 2/2010 Urso et al.
7,864,972 B2 * 1/2011 McIntosh ..... H04R 25/659 381/322

(Continued)

FOREIGN PATENT DOCUMENTS

GB 2203379 A * 10/1988 ..... H04R 25/659
WO WO-2019103748 A1 * 5/2019 ..... H04R 25/652

OTHER PUBLICATIONS

U.S. Appl. No. 16/140,322, filed Sep. 24, 2018, U.S. Pat. No. 10,701,497.

(Continued)

*Primary Examiner* — Ryan Robinson
(74) *Attorney, Agent, or Firm* — Henricks Slavin LLP

(57) ABSTRACT

A hearing device seal module for use with a hearing device core including a tubular seal carrier defining a lumen configured for passage of the hearing device core and including a resilient seal support region formed from resilient material and configured to receive the hearing device core, a seal carrier support configured to hold at least a portion of the resilient seal support region open during an insertion of the hearing device core, and a first seal secured to a first portion of the seal support region and extending outwardly therefrom.

17 Claims, 12 Drawing Sheets

(56) References Cited

U.S. PATENT DOCUMENTS

| | | | | |
|---|---|---|---|---|
| 8,184,842 | B2 * | 5/2012 | Howard | H04R 25/603 381/329 |
| 8,467,556 | B2 * | 6/2013 | Shennib | H04R 25/654 381/324 |
| 8,477,978 | B2 | 7/2013 | Caldarola | |
| 8,682,016 | B2 | 3/2014 | Wagner et al. | |
| 8,693,719 | B2 * | 4/2014 | Higgins | H04R 25/554 381/329 |
| 8,761,423 | B2 | 6/2014 | Wagner et al. | |
| 8,848,956 | B2 * | 9/2014 | Higgins | H04R 25/656 381/329 |
| 10,582,320 | B2 * | 3/2020 | Wagner | H04R 25/652 |
| 10,701,497 | B2 * | 6/2020 | Chana | H04R 25/604 |
| 2005/0123163 | A1 | 6/2005 | Oliveira et al. | |
| 2009/0074220 | A1 | 3/2009 | Shennib | |
| 2009/0202097 | A1 | 8/2009 | Tiscareno et al. | |
| 2013/0051590 | A1 * | 2/2013 | Slater | H04R 25/405 381/317 |
| 2014/0010396 | A1 * | 1/2014 | Karamuk | H04R 25/60 381/328 |
| 2015/0382094 | A1 | 12/2015 | Grinker et al. | |
| 2019/0349696 | A1 * | 11/2019 | Meier | H04R 25/48 |
| 2020/0100037 | A1 | 3/2020 | Chana et al. | |
| 2020/0296527 | A1 * | 9/2020 | Wagner | H04R 25/652 |

OTHER PUBLICATIONS

U.S. Appl. No. 17/134,290, filed Dec. 26, 2020.
U.S. Appl. No. 17/547,175, filed Dec. 9, 2021.

* cited by examiner

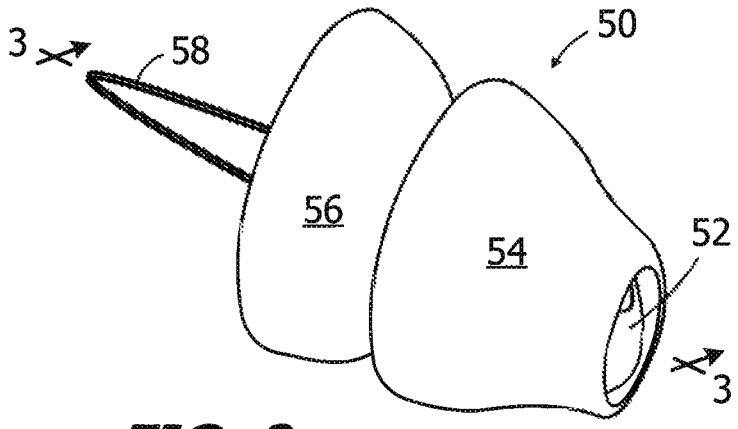
FIG. 2
Prior Art
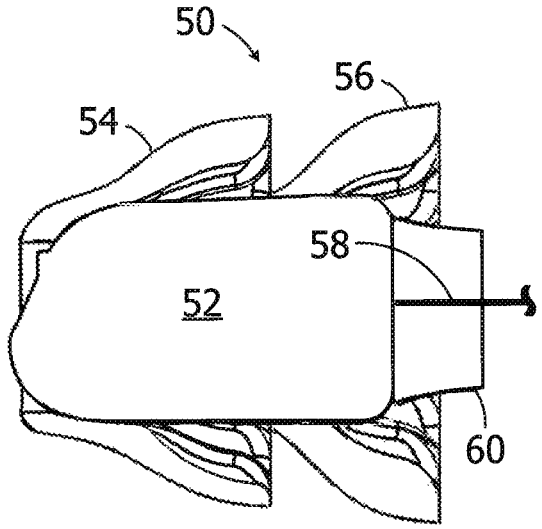
FIG. 3
Prior Art
FIG. 4
Prior Art
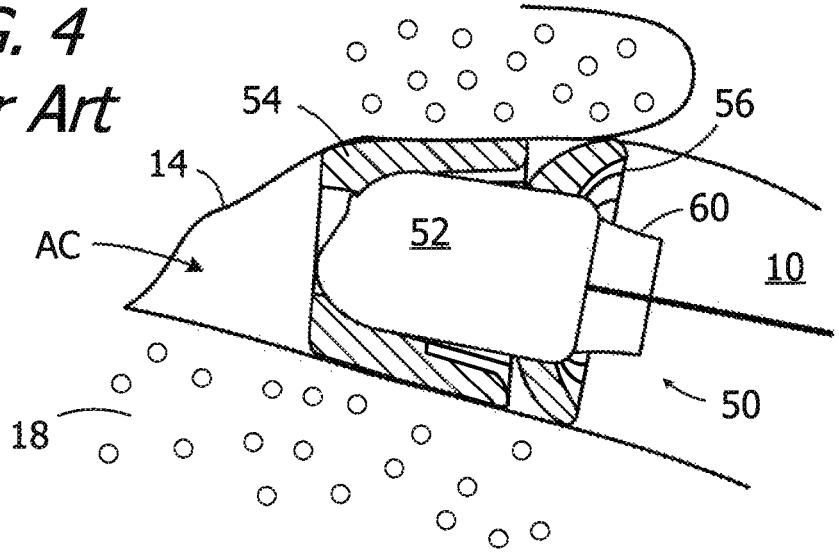

HEARING DEVICE SEAL MODULES, MODULAR HEARING DEVICES INCLUDING THE SAME AND ASSOCIATED METHODS

BACKGROUND

1. Field

The present inventions relate generally to hearing devices and, for example, hearing devices that are worn in the ear canal.

2. Description of the Related Art

Referring to the coronal view illustrated in FIG. 1, the adult ear canal 10 extends from the canal aperture 12 to the tympanic membrane (or "eardrum") 14, and includes a lateral cartilaginous region 16 and a bony region 18 which are separated by the bony-cartilaginous junction 20. Debris 22 and hair 24 in the ear canal are primarily present in the cartilaginous region 16. The concha cavity 26 and auricle 28 are located lateral of the ear canal 10, and the junction between the concha cavity 26 and cartilaginous region 16 of the ear canal at the aperture 12 is also defined by a characteristic bend 30, which is known as the first bend of the ear canal.

Extended wear hearing devices are configured to be worn continuously, from several weeks to several months, inside the ear canal. Some extended wear hearing devices are configured to rest entirely within the bony region and, in some instances, within 4 mm of the tympanic membrane. Examples of extended wear hearing devices are disclosed in U.S. Patent Pub. No. 2009/0074220, U.S. Pat. Nos. 7,664,282 and 8,682,016, each of which is incorporated herein by reference. Referring to FIGS. 2 and 3, the exemplary hearing device 50 includes a core 52, a medial and lateral seal retainers (or "seals") 54 and 56, and a removal loop 58. A contamination guard 60 with a screen (not shown) abuts the microphone. The core 52 includes a housing as well as a battery, a microphone, a receiver, and control circuitry located within the housing. The seals 54 and 56 suspend and retain the hearing device core 52 within the ear canal and also suppress sound transmission and feedback which can occur when there is acoustic leakage between the receiver and microphone. The seals 54 and 56 are frequently formed from a highly porous and highly compliant foam material (e.g., hydrophilic polyurethane foam), which conforms to the ear canal geometry by deflection and compression, as is illustrated in FIG. 4. The seals 54 and 56 are glued or otherwise permanently secured to the core 52 at the manufacturing site.

It is especially important that the seals be properly sized for the intended ear canal. An extended wear hearing device with improperly sized seals may result in a less than optimal insertion depth within the ear canal and/or gaps and folds in the seal. Less than optimal insertion depth and/or a poor seal/ear canal interface may result in, for example, discomfort, injury to the ear canal, and inadequate acoustic feedback suppression. Given the fact that hearing devices are placed in ear canals of varying shapes and sizes, hearing device manufactures typically manufacture hearing devices with a variety of seal sizes. For example, a particular hearing device may be manufactured with any of seven different seal sizes (i.e., xxS, XS, S, M, L, XL and XXL), or combinations of sizes. The hearing device seal size is typically determined during the fitting process and the patient is provided with a pre-sized hearing device with appropriately sized seals.

The present inventors have determined that there are a number of shortcomings associated with conventional methods of assembling hearing devices. For example, because the seals are glued or otherwise permanently secured to the core at the manufacturing site, fitting facilities must stock a large number of hearing devices in order to ensure that they have an appropriately sized hearing device for each patient. The carrying costs of maintaining a wide variety of sizes can be quite high, especially given the fact that some of the hearing devices will expire while in storage (due to battery lifetime). Permanently securing the seals to the core at the manufacturing site also eliminates the ability of the fitting facility to provide customized seal combinations such as, for example, a lateral seal that is larger than a medial seal in a so-called conical arrangement.

It should also be noted that various mechanical interconnects such as locking mechanisms and threaded connectors have been proposed for connecting seals to hearing device cores, especially in the context of receiver in the canal ("RIC") hearing devices. The present inventors have determined that such interconnects can be difficult to use given the small size of the RIC hearing devices, and are nevertheless too large to be used on completely in the canal ("CIC") hearing devices.

SUMMARY

A hearing device seal module in accordance with at least one of the present inventions includes a tubular seal carrier defining a lumen configured for passage of the hearing device core and including a resilient seal support region formed from resilient material and configured to receive the hearing device core, a seal carrier support configured to hold at least a portion of the resilient seal support region open during an insertion of the hearing device core, and a first seal secured to a first portion of the seal support region and extending outwardly therefrom The present inventions also include systems with a hearing device core and/or a plunger in combination with a plurality of such hearing device seal modules with different seal configurations.

There are a variety of advantages associated with the present hearing device seal modules and systems. For example, the present hearing device seal modules and associated methods allow fitting facilities to secure appropriately sized seals onto hearing device cores at the time of fitting by simply pushing the core into the seal module. The seal carrier support holds the tubular seal carrier open, reduces friction between the tubular seal carrier and the core, and otherwise facilitates passage of the core into the tubular seal carrier. This allows the assembly process to be performed quickly in an easily repeatable manner. The seals may also be removed and replaced if necessary based on, for example, patient feedback. A wide variety of seal sizes may be stored (as portions of seal modules) at the fitting facility, including rarely used sizes and differently sized seals on the same module, because the seals (and the present seal modules) are relatively inexpensive and are unlikely to expire prior to use. As such, the present hearing device seal modules and associated methods allow fitting facilities to store an appropriate number of hearing device cores, based on the expected number of patients and without regard to seal size, thereby reducing carrying costs and waste due to core expiration.

The many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

FIG. 2 is a perspective view of a conventional hearing device.

FIG. 3 is a partial section view taken along line 3-3 in FIG. 2.

FIG. 4 is a partial section view showing the hearing device illustrated in FIGS. 2 and 3 within the ear canal.

DETAILED DESCRIPTION OF EXEMPLARY EMBODIMENTS

Figure 1:
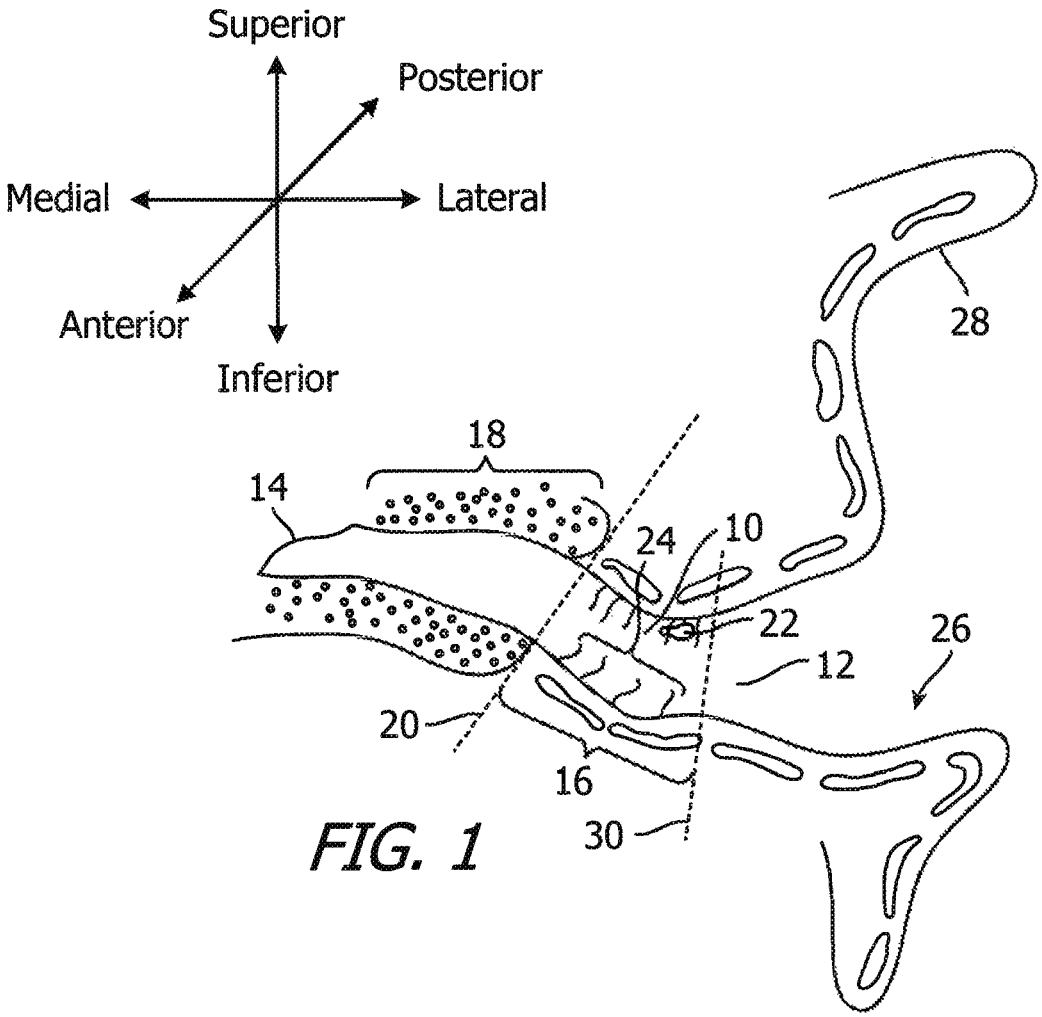
FIG. 1 is a section view showing the anatomical features of the ear and ear canal.

The following is a detailed description of the best presently known modes of carrying out the inventions. This description is not to be taken in a limiting sense, but is made merely for the purpose of illustrating the general principles of the inventions. Referring to FIG. 1, it should also be noted that as used herein, the term "lateral" refers to the direction and parts of hearing devices which face away from the tympanic membrane when within an ear canal, the term "medial" refers to the direction and parts of hearing devices which face toward the tympanic membrane when within an ear canal, the term "superior" refers to the direction and parts of hearing devices which face the top of the head when within an ear canal, the term "inferior" refers to the direction and parts of hearing devices which face the feet when within an ear canal, the term "anterior" refers to the direction and parts of hearing devices which face the front of the body when within an ear canal, and the "posterior" refers to the direction and parts of hearing devices which face the rear of the body when within an ear canal.

Figure 5:
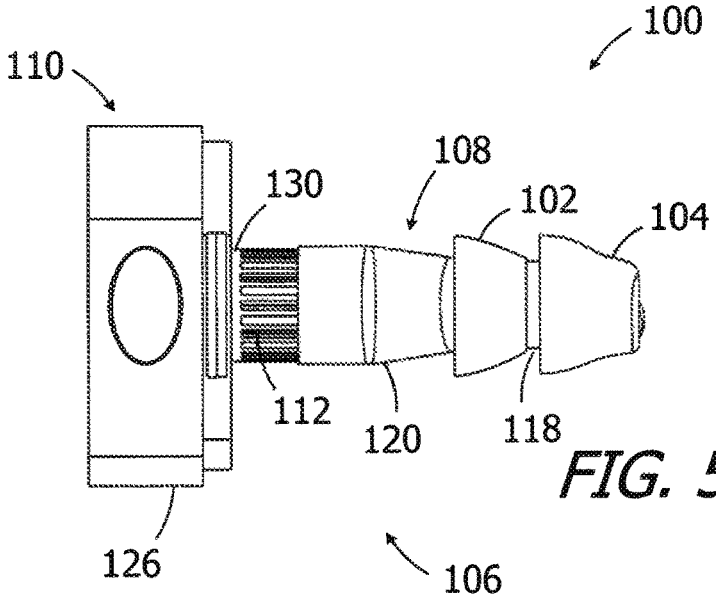
FIG. 5 is a side view of a hearing device seal module in accordance with one embodiment of a present invention.
Figure 6:
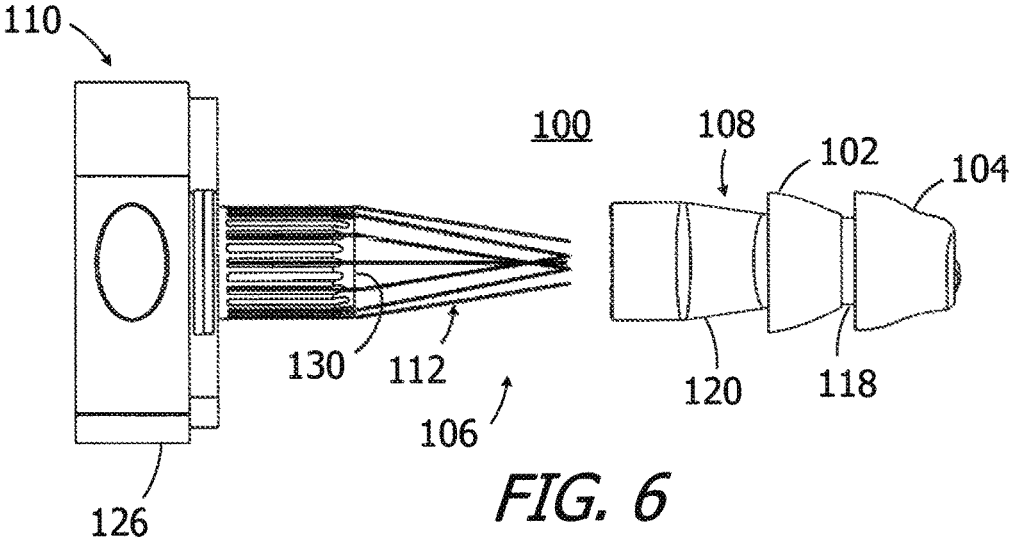
FIG. 6 is an exploded view of the hearing device seal module illustrated in FIG. 5.
Figure 7:
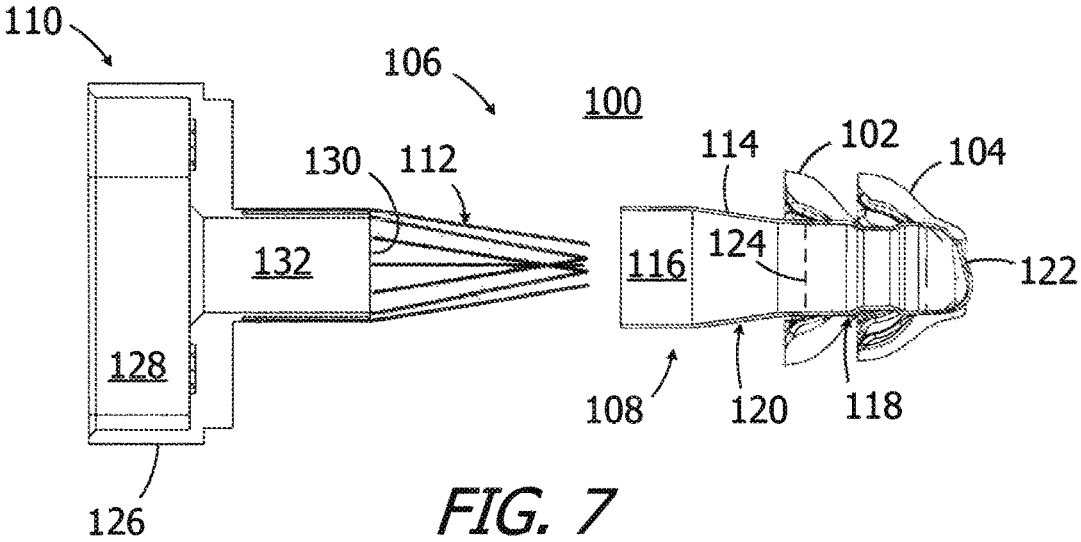
FIG. 7 is an exploded section view of the hearing device seal module illustrated in FIG. 5.

As illustrated in FIGS. 5-7, an exemplary hearing device seal module 100 in accordance with one embodiment of a present invention includes seals 102 and 104 and an assembly apparatus 106 that may be used both to position the seals onto a hearing device core (or "core") and to secure the seals to the hearing device core. The seals 102 and 104 may be secured to the assembly apparatus 106 through the use of adhesive or any other suitable instrumentality. In at least some instances, the assembly apparatus 106 will semi-permanently secure the seals to the hearing device core. As used herein, seals that are "semi-permanently secured" to the hearing device core are seals that will remain secured to the core under expected use conditions and that can be removed from the core without damage to the core if so desired. For example, should it be determined during fitting that the seals 102 and 104 are not the most optimal size, the seals may be removed from the core and replaced with seals from another seal module 100.

Although the present modules are not limited to any particular type of hearing device seal, the exemplary seals 102 and 104 are the same as those commonly employed on extended wear hearing devices and, accordingly, are configured to substantially conform to the shape of walls of the ear canal, maintain an acoustical seal between a seal surface and the ear canal, and retain the hearing device core securely within the ear canal. Additional information concerning the specifics of exemplary seals may be found in U.S. Pat. No. 7,580,537, which is incorporated herein by reference. With respect to materials, the seals 102 and 104 be formed from compliant material configured to conform to the shape of the ear canal. Suitable materials include elastomeric foams having compliance properties (and dimensions) configured to conform to the shape of the intended portion of the ear canal (e.g., the bony portion) and exert a spring force on the ear canal so as to hold the core in place in the ear canal. Exemplary foams, both open cell and closed cell, include but are not limited to foams formed from polyurethanes, silicones, polyethylenes, fluoropolymers and copolymers thereof. Hydrophilic polyurethane foam is one specific example.

The exemplary assembly apparatus 106 illustrated in FIGS. 5-7 includes a tubular seal carrier 108, a handle 110, and a seal carrier support 112 within at least a portion of the tubular seal carrier that is configured to hold the tubular seal carrier open. The seal carrier support 112 may, for example, be configured to hold the tubular seal carrier 108 open before and during insertion of the hearing device core. The seal carrier 108, which is discussed in greater detail below with reference to FIGS. 15-18, has an outer wall 114 that defines an internal lumen 116, a seal support region 118, and a connector region 120 that extends from the seal support region to the handle 110. The medial end of the seal carrier 108 has a sound aperture 122. A weakened area 124, defined for example by a score line, spaced perforations or one or more slits, facilitates separation of the seal support region 118 from the connector region 120 after the seal support region secures the seals 102 and 104 to a hearing device core in, for example, the manner described below with reference to FIGS. 22-27. The exemplary handle 110, which is discussed in greater detail below with reference to FIGS. 9-11, includes a base 126 with a receptacle 128 as well as a support tube 130 with a lumen 132. The seal carrier support 112 is mounted to the support tube 130, and the hearing device core will pass through the support tube lumen 132 and the seal carrier support 112 during the assembly process.

Figure 8A:
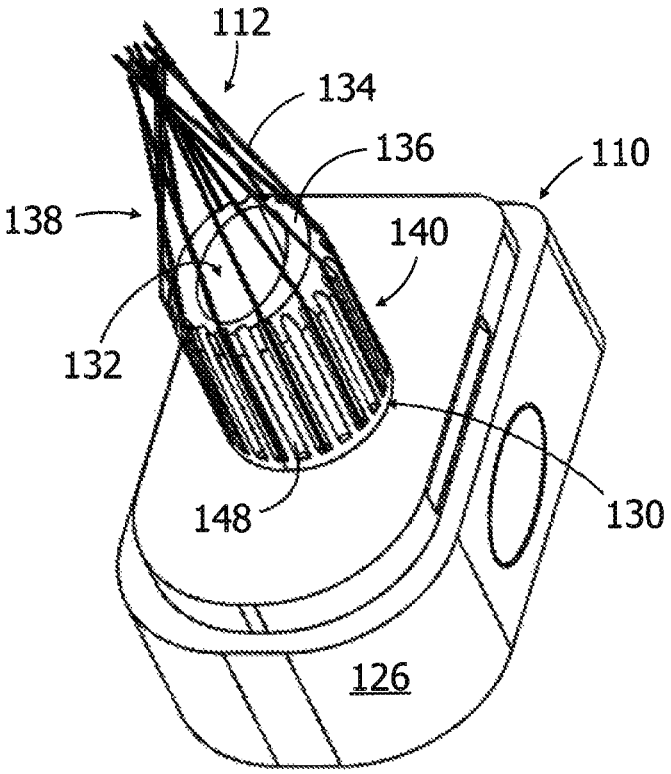
FIG. 8A is a perspective view of a portion of the hearing device seal module illustrated in FIG. 5.
Figure 8B:
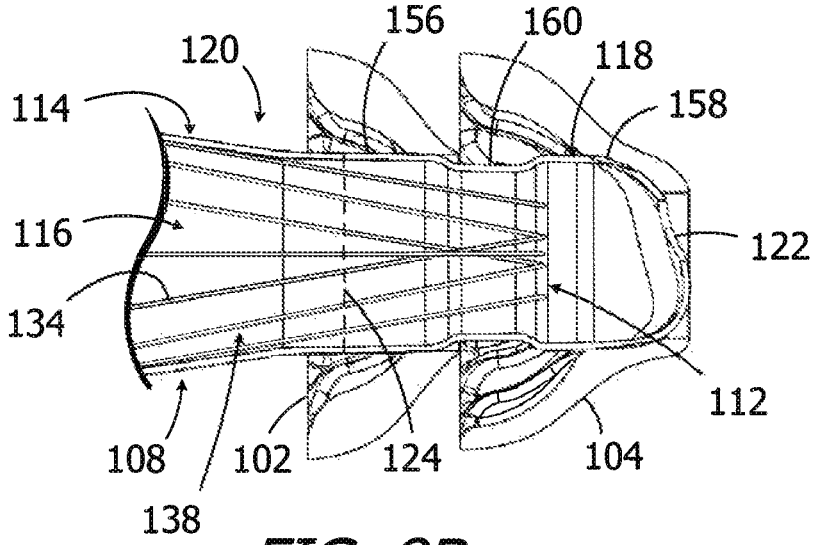
FIG. 8B is a section view of a portion of the hearing device seal module illustrated in FIG. 5.

Turning to FIGS. 8A and 8B, the exemplary seal carrier support 112 includes a plurality of elongate members 134 that extend into the tubular seal carrier 108. The seal carrier support 112 holds the seal carrier 108 open, thereby preventing it from collapsing, as a hearing device core passes through the seal carrier during the assembly process described below with reference to FIGS. 22-27. The seal carrier support 112 may also act as a guide to properly orient the hearing device core relative to the seal carrier 108, and may reduce the friction forces acting on the core as it moves within the seal carrier.

The exemplary seal carrier support 112 extends at least from the support tube end 136 to the seal support region 118 of the seal carrier 108. The seal carrier support 112 includes a tapered, generally conical portion 138 with a shape corresponding to the connector region 120 of the seal carrier 108. In the illustrated implementation, the seal carrier support 112 extends past the weakened area 124 and the lateral seal 102 to a location within the seal support region 118 that is aligned with medial seal 104. The seal carrier support 112 in the illustrated implementation also includes a base portion 140 that mounts the seal carrier support onto the support tube 130 of the base 126. The seal carrier support 112 in the illustrated implementation will also be separated from the seal support region 118 of the seal carrier 108 after the hearing device core has reached the medial end of the seal carrier.

In the illustrated embodiment, the elongate members 134 are in the form of wires. Suitable wire materials include, but are not limited to, stainless steel or PTFE-coated stainless steel. The elongate members 134 may also be filaments and molded bristles formed from materials such as Nylon or PTFE. It also should be noted, however, that any suitable structure(s), or combinations of structures, may be used to form the seal carrier support 112. By way of example, but not limitation, a lubricious tube may be positioned within the seal carrier 108 in place of, or in addition to, the elongate members 134.

Figure 9:
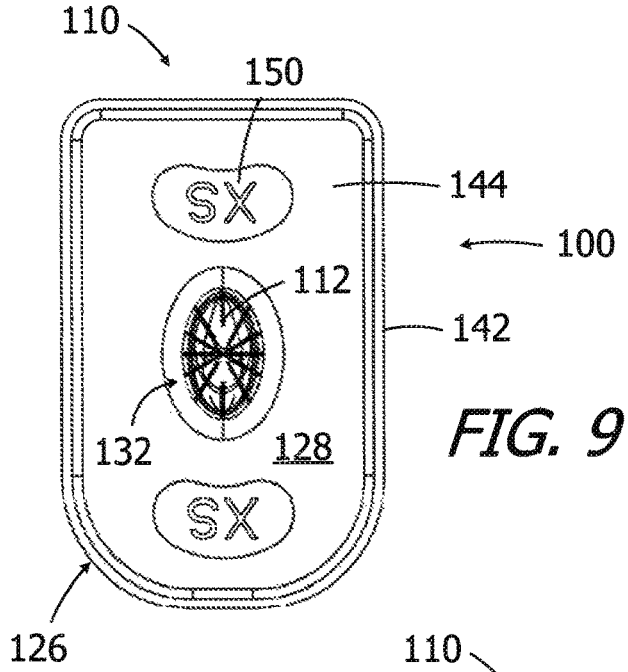
FIG. 9 is a bottom view of the hearing device seal module illustrated in FIG. 5.
Figure 10:
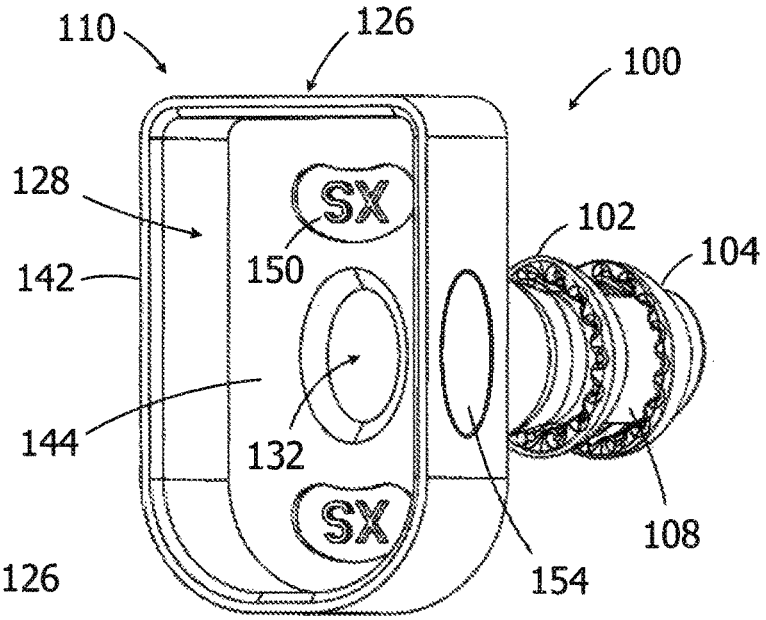
FIG. 10 is a perspective view of the hearing device seal module illustrated in FIG. 5.
Figure 11:
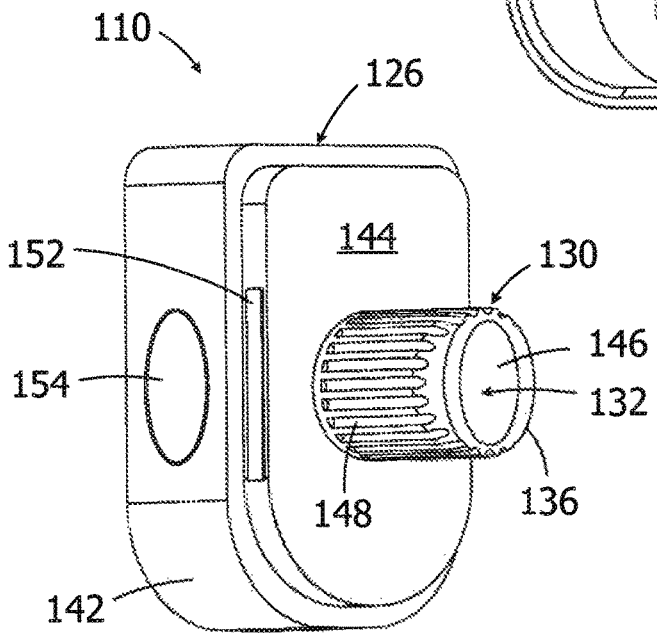
FIG. 11 is a perspective view of a portion of the hearing device seal module illustrated in FIG. 5.

Referring to FIGS. 9-11, and as noted above, the exemplary handle 110 includes a base 126 with a receptacle 128 as well as a support tube 130 with a lumen 132. The receptacle 128 is defined by a side wall 142 and an end wall 144, and the lumen 132 extends through the end wall. The support tube 130 has a tubular wall 146 with an interior surface that defines the lumen 132 and an exterior surface that is configured to mount the seal carrier support 112. In the illustrated implementation, where the seal carrier support 112 includes a plurality of elongate members 134, the exterior surface of the support tube wall 146 (which is also the exterior of the surface of the support tube 130) includes a plurality of indentations 148. Although the present inventions are not so limited, each indentation 148 is capable of receiving a portion of one of the elongate members 134 in the manner illustrated in FIG. 8A. The elongate members 134 may be secured to the indentations 148 with adhesive or another suitable method. Depending on the implementation, the respective number of elongate members 134 and indentations 148 may be the same or there may be more indentations than elongate members. The elongate members 134 may be evenly distributed in the indentations 148 (e.g., elongate members located in every other indentation as shown) or unevenly distributed. For example, there may be more elongate members 134 near the smaller radius regions at the ends of the major diameter of the oval tubular seal carrier 108. In at least one implementation, there may be twelve elongate members 134 and twenty-four indentations 148. The connector region 120 of the seal carrier 108 is also mounted on and secured to the support tube 130 (FIG. 5) with adhesive or another suitable instrumentality.

The lumen 132 has an oval shape corresponding to the oval shape of the associated hearing device core to facilitate proper orientation of the core during assembly of the hearing device. Indicia 150 that identifies the respective sizes of the seals 102 and 104, which may be the same or different, may also be provided on the handle 110. For example, there may be two sets of indicia 150 on the surface of end wall 144 that faces the receptacle 128.

Figure 30:
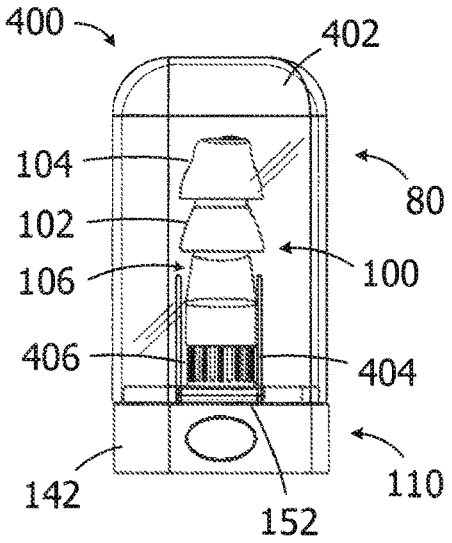
FIG. 30 is a front view of a seal module package in accordance with one embodiment of a present invention.
Figure 31:
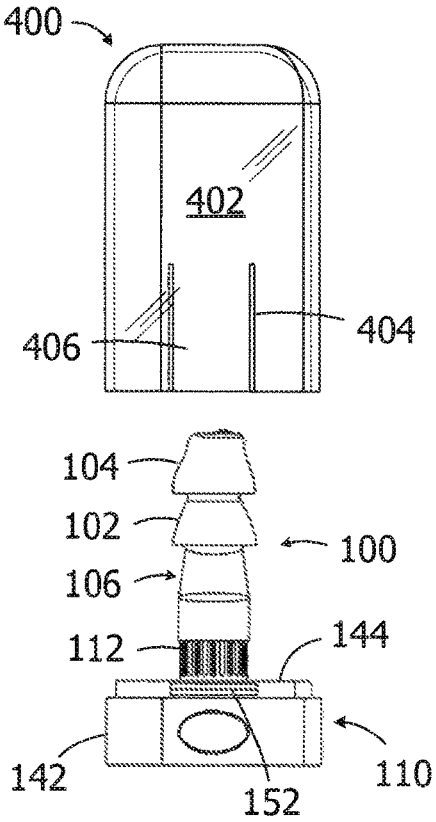
FIG. 31 is an exploded view of the seal module package illustrated in FIG. 30.

In some instances, one or more latches 152 may be provided on the handle base 126. The latches 152 engage the corresponding latches 406 of a storage cover 400 in the manner described below with reference to FIGS. 30 and 31. Finger depressions 154 may be provided on the handle side wall 142 to make the handle easier to grip when the cover 400 is removed as well as during the hearing device assembly process.

Figure 12:
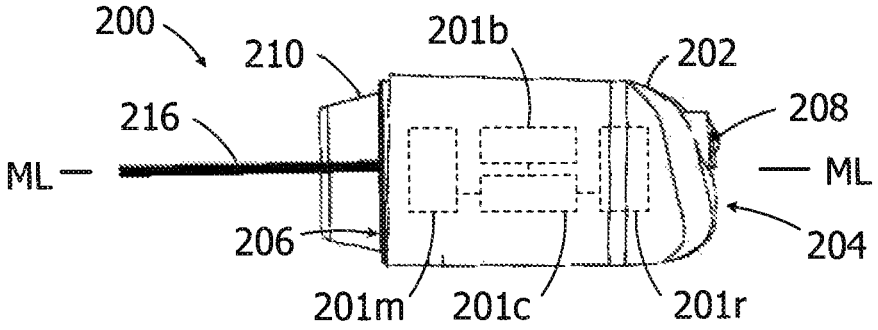
FIG. 12 is a side view of a hearing device core.
Figure 13:
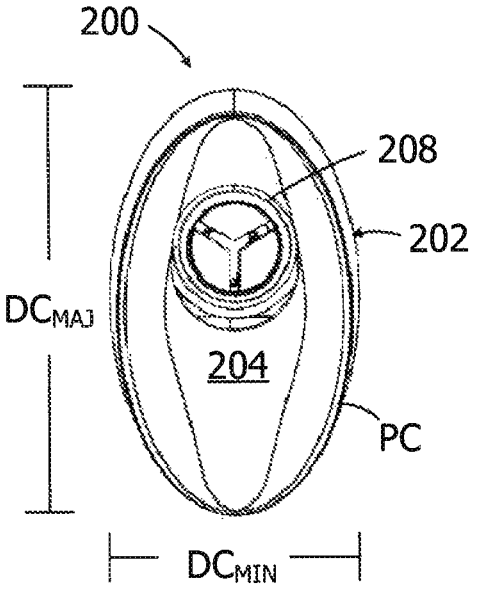
FIG. 13 is an end view of the hearing device core illustrated in FIG. 12.
Figure 14:
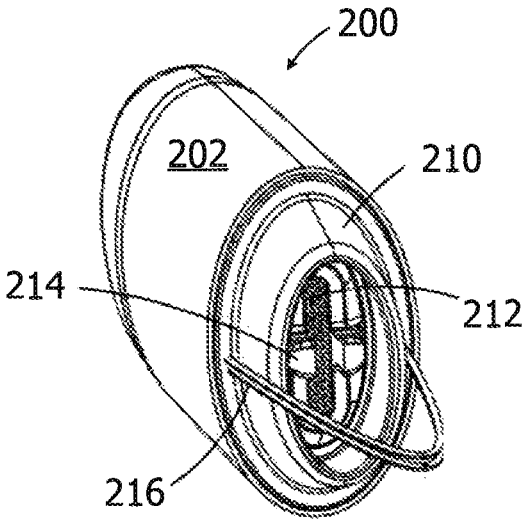
FIG. 14 is a perspective view of the hearing device core illustrated in FIG. 12.
Figure 15:
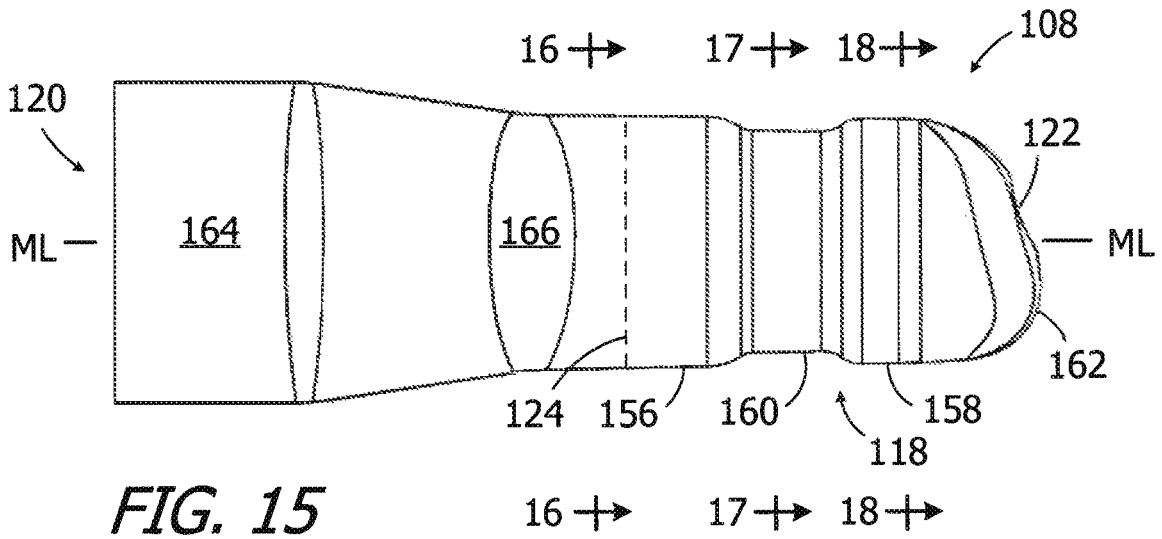
FIG. 15 is a side view of a portion of the hearing device seal module illustrated in FIG. 5.
Figure 16:
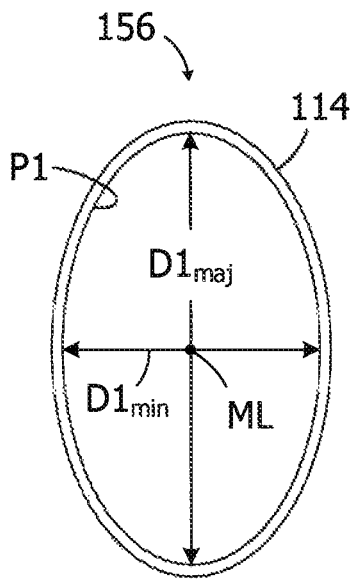
FIG. 16 is a section view taken along line 16-16 in FIG. 15.
Figure 17:
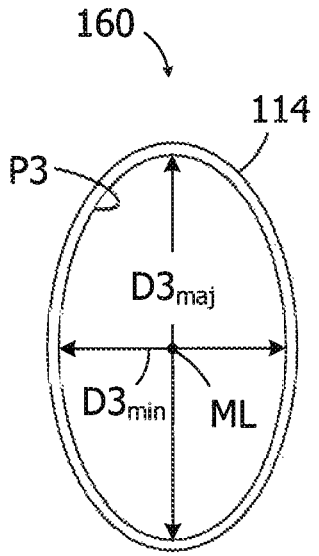
FIG. 17 is a section view taken along line 17-17 in FIG. 15.
Figure 18:
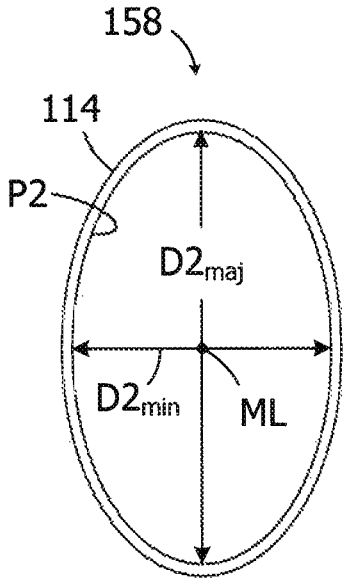
FIG. 18 is a section view taken along line 18-18 in FIG. 15.

One example of a hearing device core is the core 200 illustrated in FIGS. 12-14. The exemplary core 200 includes a housing 202, with medial and lateral ends 204 and 206 and a receiver port 208, a contamination guard 210 with a screen 212, a pair of tabs 214 that may be used during insertion and removal of a hearing device into the ear, and a removal loop 216. The exemplary core 200 also includes a battery 201*b*, a microphone 201*m*, a receiver 201*r*, and control circuitry 201*c* that are operably connected to one another and are located within the housing 202. Exemplary hearing device cores are illustrated and described in, for example, U.S. Pat. No. 8,761,423, which is incorporated herein by reference.

The present inventions are not, however, limited to any particular type of hearing device core.

Although the present cores are not limited to any particular shapes, the exemplary hearing device core 200 illustrated in FIGS. 12-14 has an oval shape (e.g., an elliptical or at least substantially elliptical shape), defined by the outer surface of the housing 202, in planes perpendicular to the medial-lateral axis ML that extends through the center of the hearing device. The oval shape defines a major dimension $DC_{MAJ}$, a minor dimension $DC_{MIN}$, and an outer perimeter PC. These dimension taper (or "decrease") slightly in the lateral to medial direction in the exemplary implementation. Additionally, the receiver port 208 is not centered on the medial-lateral axis ML. Put another way, the housing 202 and the receiver port 208 are not coaxial.

Turning to FIGS. 15-18, the exemplary hearing device seal module 100 is configured to create an interference fit with the associated hearing device core 200 and, given that the seals 102 and 104 are part of the seal module, secure the seals to the core. In particular, the seal support region 118 of the exemplary seal carrier 108 is configured to create an interference fit with the hearing device core 200. In at least some instances, the exemplary seal carrier 108 is configured to create an interference fit with the hearing device core 200 that will semi-permanently secure the seals 102 and 104 to the core so that the seals will remain secured to the core under expected use conditions and can be removed from the core, along with the associated portion of the seal carrier 108, without damage to the core.

In the embodiment illustrated in FIGS. 15-18, the seal support region 118 of the exemplary seal carrier 108, which is shown here in its unstretched (or "relaxed" or "unstressed") state, has a lateral portion 156, a medial portion 158, a central portion 160 located between the medial and lateral portions, and a medial end 162. In the illustrated implementation, seal 102 may be secured to the lateral portion 156 of the support region 118, seal 104 may be secured to the medial portion 158 of the support region, and central portion 160 may be located between the seals, in the manner illustrated in FIG. 8B. The connector region 120 has a lateral portion 164 that is secured to the handle 110 and a medial portion 166 that abuts the seal support region 118 at the weakened area 124.

The aforementioned interference fit is created when at least the central portion 160 resiliently stretches as the associated core 200 is pushed into the seal support region 118. As such, the respective dimensions of the seal carrier 108 and the associated hearing device core 200 are such that at least the central portion 160 is smaller than the portion of the associated core 200 that is aligned therewith when the core is fully inserted into the seal carrier 108, i.e., when the medial end 204 of the core housing 202 abuts the medial end 162 of the seal carrier seal support region 118. The material used to form the wall 114 of the seal carrier 108, or at least the seal support region 118 thereof, may be a relatively thin (e.g., 10-20 μm) material that is resilient and, in at least some embodiments, relatively tacky. Suitable materials include, but are not limited to, polyurethane and silicone.

The seal support region 118 of the exemplary seal carrier 108 (which is shown in a relaxed, or unstressed, state in FIGS. 15-18) defines a shape, size and resilience that results in an interference fit with the associated hearing device core 200 when the core is in the seal support region 118. In particular, the shape, size and resilience of at least the central portion 160 will result in the resilient stretching (or "elastic deformation" or "a stressed state") of at least the central portion when the core is in the seal support region 118. In the illustrated implementation, the lateral portion 156, medial portion 158 and central portion 160 of the seal support region 118 each have an oval shape (e.g., an elliptical or at least substantially elliptical shape) in planes perpendicular to the medial-lateral axis ML that extends through the center of the seal carrier. The oval shapes defines respective major dimensions $D1_{MAJ}$, $D2_{MAJ}$ and $D3_{MAJ}$, respective minor dimensions $D1_{MIN}$, $D2_{MIN}$ and $D3_{MIN}$, and respective inner perimeters P1, P2 and P3. In the illustrated implementation, the inner perimeter P3 of the central portion 160 is smaller than the inner perimeters P1 and P2 of the lateral portion 156 and medial portion 158. Differences in inner perimeter size may be accomplished through differences in the major and/or minor dimensions and, in the illustrated embodiment, the differences in inner perimeter size may be accomplished through differences in both the major and minor dimensions. To that end, the major and minor dimensions $D3_{MAJ}$ and $D3_{MIN}$ of the central portion 160 are respectively less than the major and minor dimensions $D1_{MAJ}$ and $D1_{MIN}$ of the lateral portion 156 and are respectively less than the major and minor dimensions $D2_{MAJ}$ and $D2_{MIN}$ of the medial portion 158. The connector region 120 also has an oval shape.

Turning to the dimensional relationship between the exemplary seal carrier 108 and the hearing device core 200, and when core is fully inserted into the seal carrier (note FIG. 24), the inner perimeters P1 and P2 of the seal support region lateral and medial portions 156 and 158 are at least substantially equal in length (i.e., +/−1%) to the outer perimeter PC of the associated (i.e., aligned) portions of the core. The length of the inner perimeter P3 of the seal support region middle portion 160 less than (e.g., 7 to 10% less than) the outer perimeter PC of the associated portion of the core 200. Additionally, in the illustrated implementation, the major and minor dimensions $D3_{MAJ}$ and $D3_{MIN}$ of the seal support region central portion 160 are less than the respective major and minor dimensions $DC_{MAJ}$ and $DC_{MIN}$ of the associated portion of the core 200 (e.g., 7 to 10% less than), while the major and minor dimensions $DC_{MAJ}$ and $DC_{MIN}$ of the associated portions of the core are at least substantially equal to (i.e., +/−1%) the major and minor dimensions $D1_{MAJ}$ and $D1_{MIN}$ of the lateral portion 156 as well as the major and minor dimensions $D2_{MAJ}$ and $D2_{MIN}$ of the medial portion 158. It should also be noted that in those instances where the size of the core taper (or "decrease") slightly in the lateral to medial direction, seal support region 118 may taper correspondingly.

As noted above with reference to FIGS. 12-14, the receiver port 208 is not centered on the medial-lateral axis ML of the core 200. Additionally, the medial end 204 of the housing 202 has an inferior protrusion. The seal support region 118 in the illustrated embodiment may have a corresponding configuration. To that end, and referring to FIG. 15, the sound aperture 122 is also not centered on the medial-lateral axis ML and, as a result, the receiver port 208 will be aligned with the sound aperture 122 when the seal carrier 108 and hearing device core 200 are properly oriented relative to one another. The medial end 162 of the seal support region 118, which is closed but for the sound aperture, has an inferior protrusion.

Figure 19:
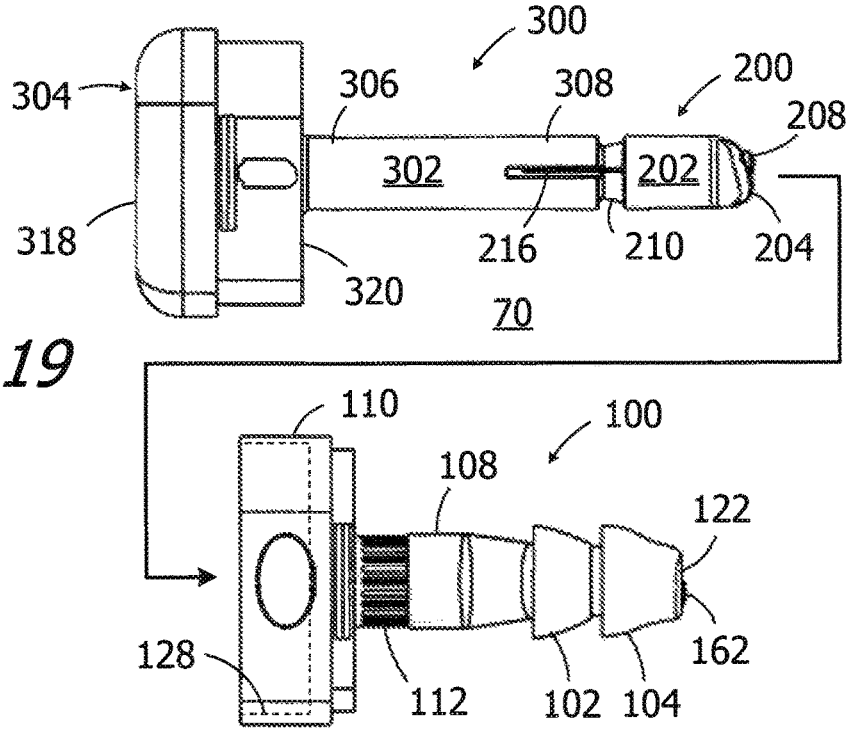
FIG. 19 is a side view a system in accordance with one embodiment of a present invention.
Figure 20:
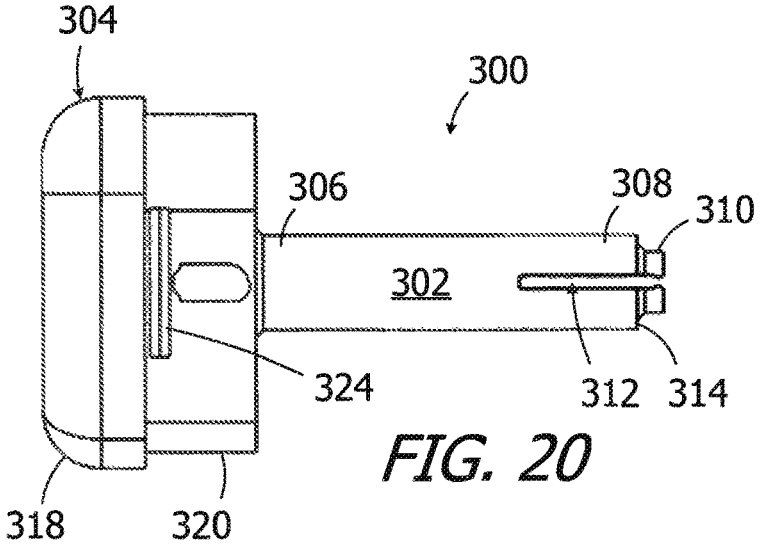
FIG. 20 is a side view of a portion of the system illustrated in FIG. 19.
Figure 21:
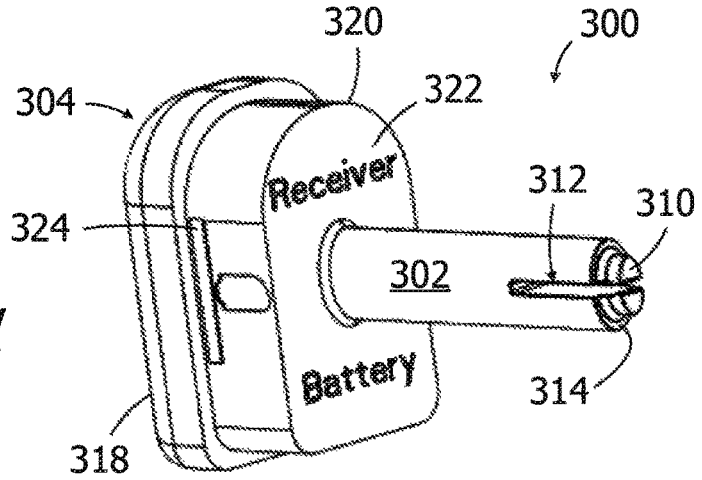
FIG. 21 is a perspective view of a portion of the system illustrated in FIG. 19.

The exemplary hearing device seal module 100 may be combined with the exemplary plunger 300 illustrated in FIGS. 19-21 to form a system 70 that is used to mount the seals 102 and 104 onto a hearing device core such as, for example, the core 200. The exemplary plunger 300 includes a rod 302 that is configured to hold the core 200 and a handle 304. The exemplary rod 302 may have an oval shaped cross-section and a size corresponding to the oval shape and size of the support tube lumen 132. The end 306 of the rod 302 is secured to, is integral with, or is otherwise associated with the handle 304, while the other end of the rod, i.e., the free end 308, is configured to hold the core 200. In the illustrated embodiment, the rod free end 308 includes a connector 310, a slot 312 to accommodate the core removal loop 216, and an abutment 314. The connector 310 is configured to extend into the core contamination guard 210 and engage the tabs 214 (FIG. 14) with a relatively light connection force, i.e. a force large enough to prevent the core 200 from falling off of the rod 302 but small enough to allow the core to be separated from the rod without damage to the core. The connector 310 is also configured in such a manner that the abutment 316 will rest against the contamination guard 210 when the tabs 214 are engaged. The exemplary handle 304 may include a base 318 and a protrusion 320, and the length of the rod 302 is such that medial end 204 of the core 200 will abut the medial end 162 of the seal carrier 108 prior to the plunger 300 being fully inserted into the seal module 100 for the reasons discussed below with reference to FIGS. 22-27.

The seal module 100 and plunger 300 may also be configured so as to increase the likelihood that the core 200 will be properly oriented relative to the seal carrier 108, and the receiver port 208 will be aligned with the sound aperture 122 when a core 200 in the correct superior-inferior orientation reaches the seal support region 118. For example, and as noted above with reference to FIGS. 9-11, the assembly apparatus lumen 132 has an oval shape that is similar in size to the hearing device core 200, which prevents the core from rotating relative to the handle 110 after the core has been inserted into the lumen 132. The plunger rod 302 may be similarly sized and oval shaped in cross-section. Additionally, the size and shape of the protrusion 320 on the plunger handle 304 may correspond to the size and shape of handle receptacle 128 on the assembly apparatus handle 110. The shapes may be such that there is only one orientation of the plunger 300 relative to the seal module 100 that will allow the plunger to be fully inserted into the assembly apparatus. In the illustrated implementation, the receptacle 128 (FIGS. 9 and 10) and the protrusion 320 (FIG. 21) are each, in cross-sections perpendicular to the central axis of the lumen 132 and the central axis of the of the plunger rod 302, rectangular in shape with one end semi-circular. The handle 304 may also be provided with indicia 322 that indicates the intended superior-inferior orientation of the hearing device core 300.

Figure 33:
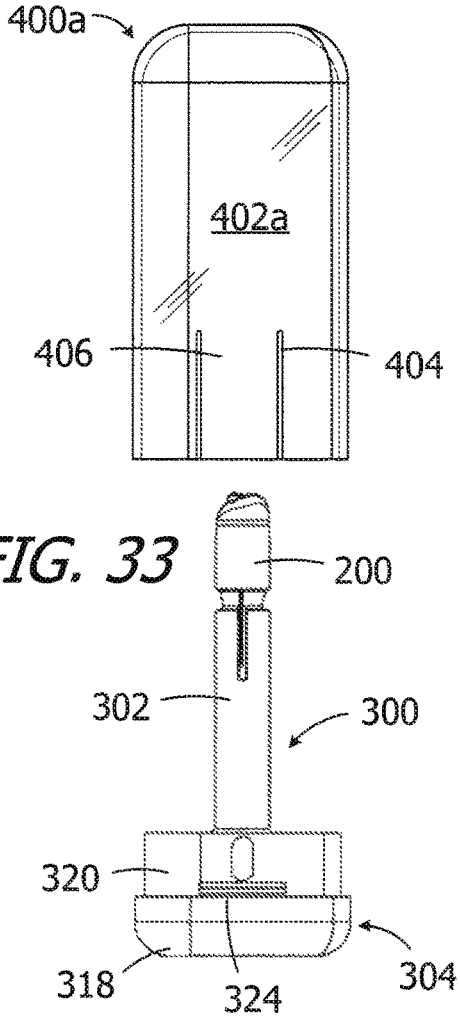
FIG. 33 is an exploded view of the core and plunger package illustrated in FIG. 32.

In some instances, one or more latches 324 may be provided on the handle protrusion 320. The latches 324 engage the corresponding latches 406 of a storage cover **400*a* in the manner described below with reference to FIGS. 33 and 34**.

Figure 22:
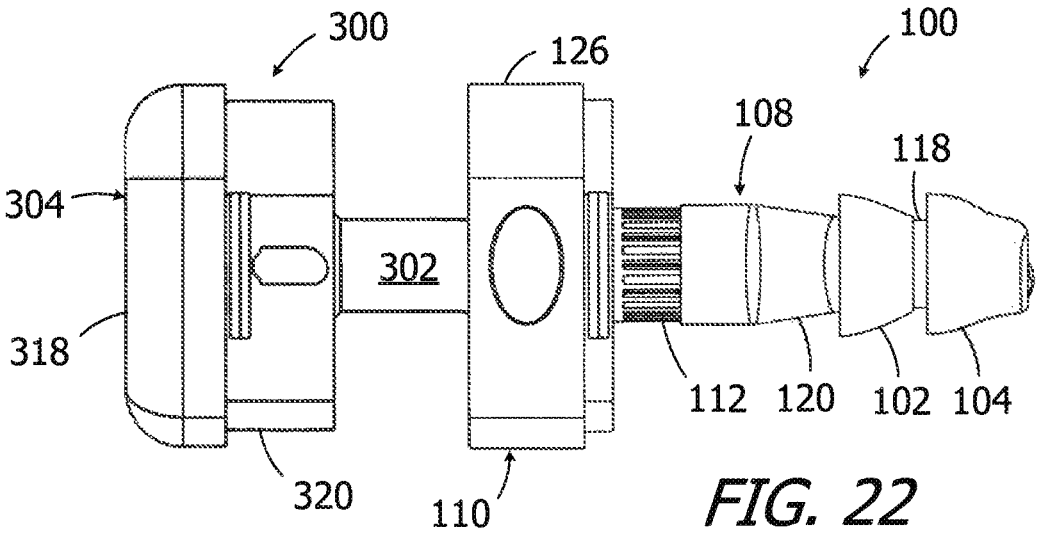
FIG. 22 is a side view showing a portion of an exemplary hearing device assembly method employing the hearing device system illustrated in FIG. 19.

One exemplary method of securing one or more seals (e.g., seals 102 and 104) to a hearing device core (e.g., core 200) with the exemplary seal module 100 and plunger 300 is illustrated in FIGS. 19 and 22-27. Referring first to FIG. 19, a hearing device core 200 that is mounted on the plunger 300 in the intended oriented relative to the plunger may be inserted into the hearing device seal module 100. Here, the plunger handle 304 is aligned with the assembly apparatus handle 110 so that the plunger handle protrusion 320 can be inserted into seal module handle receptacle 128, and the oval plunger rod 302 and oval hearing device core 200 can be inserted into the support tube lumen 132 (FIG. 22). The seal carrier support 112 will hold the tubular seal carrier 108 open as the hearing device core 200 is pushed though the internal lumen 116 of the tubular seal carrier by the plunger 300. The hearing device core 200 will push open the elongate members 134 in the tapered, generally conical portion 138 of the seal carrier support 112, and will thereafter pass the medial end of the seal carrier support.

Figure 23:
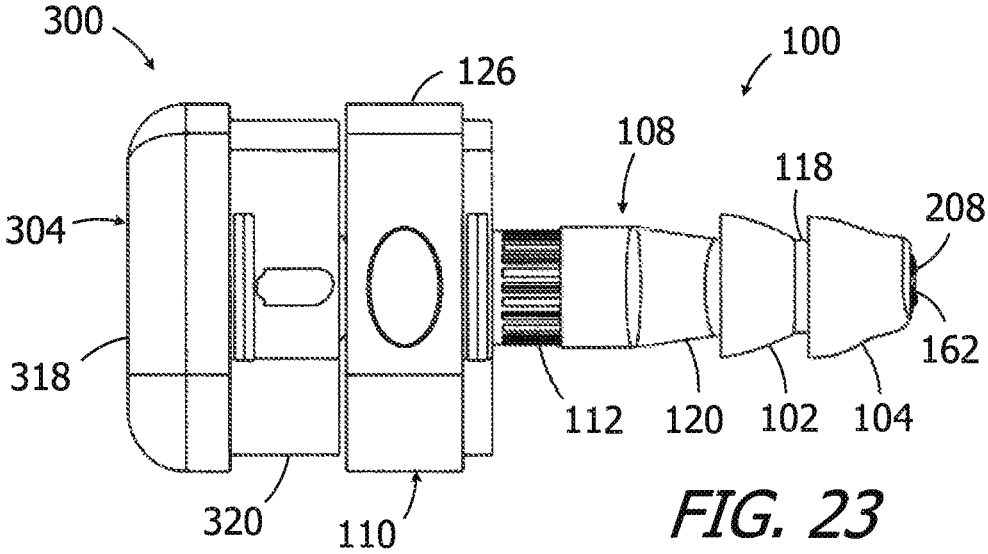
FIG. 23 is a side view showing a portion of an exemplary hearing device assembly method employing the hearing device system illustrated in FIG. 19.
Figure 24:
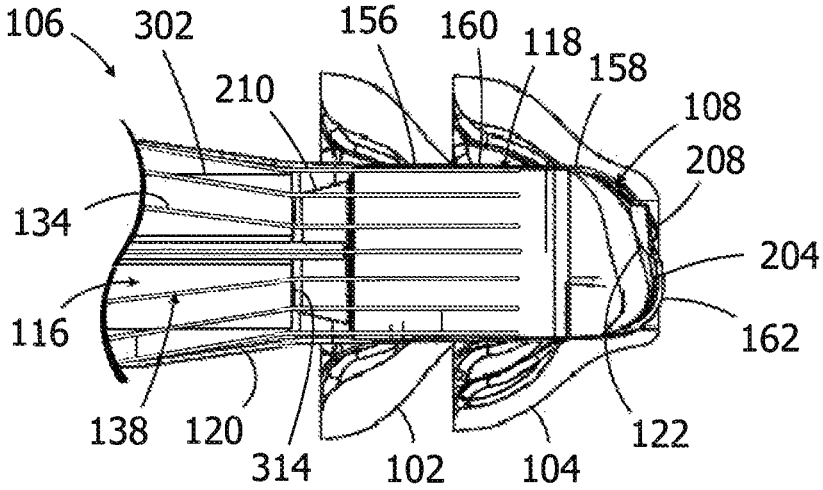
FIG. 24 is a section view showing a portion of an exemplary hearing device assembly method employing the hearing device system illustrated in FIG. 19.

The respective states of the seal module 100, hearing device core 200 and plunger 300 when the core initially reached the fully inserted position within the seal carrier 108, i.e., when the medial end 204 of the core housing 202 abuts the medial end 162 of the seal carrier seal support region 118, is shown in the FIGS. 23 and 24. The core 200 will stretch (or "stress" or "elastically deform") the central portion 160 of the tubular seal carrier seal support region 118. The resilience of the material used to form the seal support region 118, and the tackiness of the material (if tacky), creates the above-described interference fit that semi-permanently secures the seals 102 and 104 to the core 200. Although the hearing device core 200 is fully inserted into the seal module 100, and the abutment 314 of the plunger rod 302 is pressed against the core 200, the plunger 300 is not fully inserted into the seal module. The plunger handle protrusion 320 has not been inserted into seal module handle receptacle 128, and the seal support region 118 remains attached to connector region 120 (i.e., the weakened area 124 is still intact).

Figure 25:
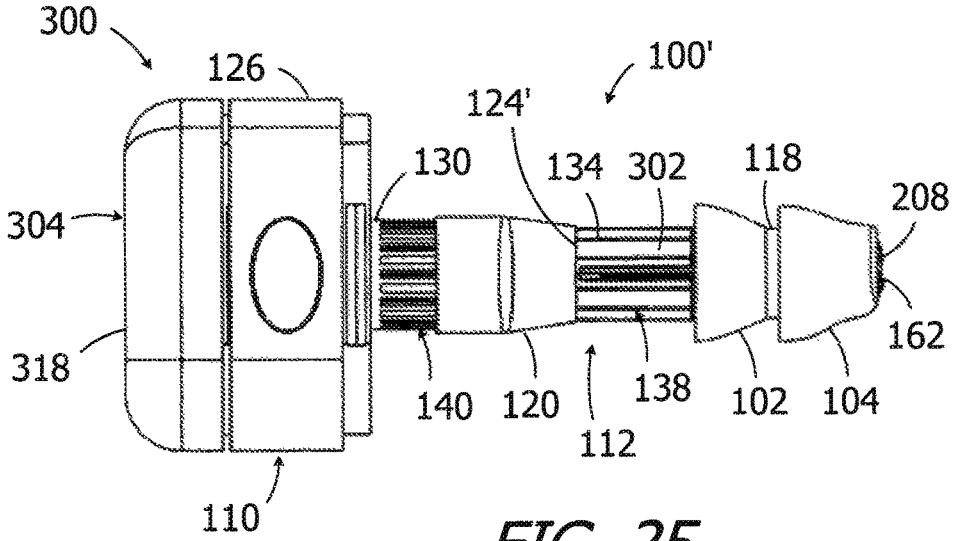
FIG. 25 is a side view showing a portion of an exemplary hearing device assembly method employing the hearing device system illustrated in FIG. 19.
Figure 26:
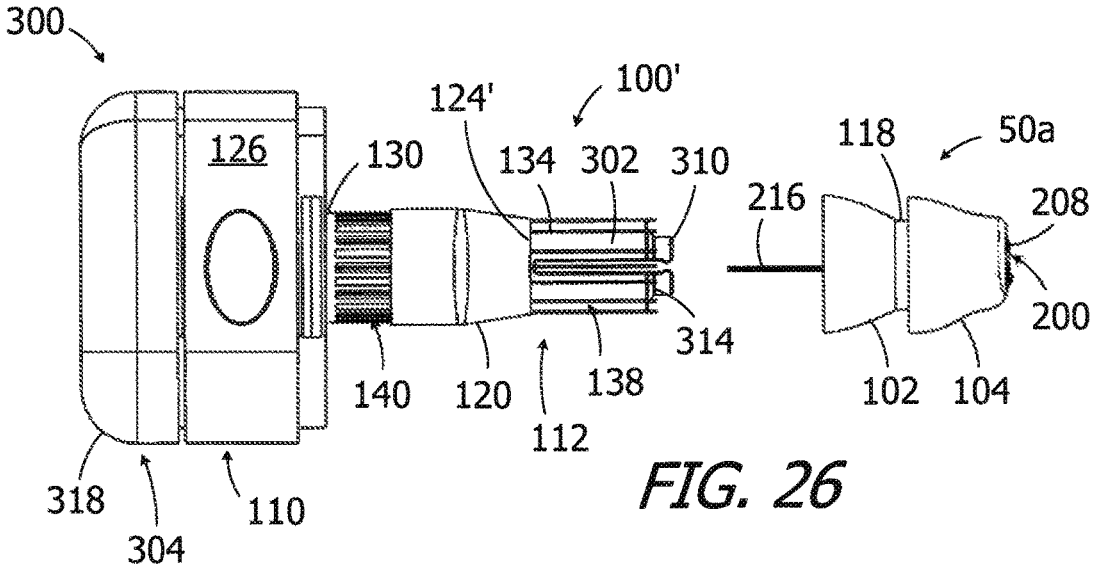
FIG. 26 is a side view showing a portion of an exemplary hearing device assembly method employing the hearing device system illustrated in FIG. 19.
Figure 27:
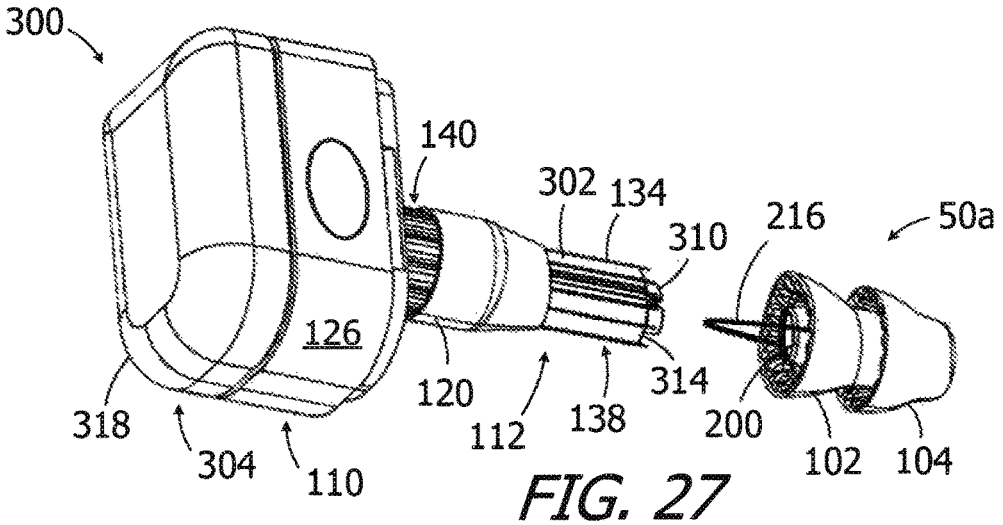
FIG. 27 is a perspective view showing a portion of an exemplary hearing device assembly method employing the hearing device system illustrated in FIG. 19.

Continued movement of the plunger 300 relative to the seal module 100 in the medial direction will cause the plunger handle protrusion 320 to enter the seal module handle receptacle 128, as shown in FIG. 25, thereby completing the plunger insertion process. The weakened area 124 (FIG. 8B) of the seal carrier 108 will fail, resulting in the separation of the seal support region 118 from the connector region 120 to create weakened area edges 124'. The result is a hearing device **50*a* that includes the core 200, the seals 102 and 104, and the seal support region 118 of the seal carrier 108. The hearing device 50*a* may remain secured to plunder rod 302 by way of the connector 310 and may be separated from the plunder rod as shown in FIGS. 26 and 27. Given that the connector region 120 of the seal carrier 108 and the seal carrier support 112 are secured to the handle support tube 130, and that the seal carrier support is not secured to the seal support region 118, the seal carrier support and the seal carrier connector region will remain as part of the spent seal module 100'. The plunger 300 will also remain with the spent seal module 100'**.

It should also be noted that, in other assembly methods, the plunger may be omitted and the clinician may insert a hearing device core (e.g., core 200) into a seal module (e.g., seal module 100) with a forceps or other suitable instrumentality.

Figure 28:
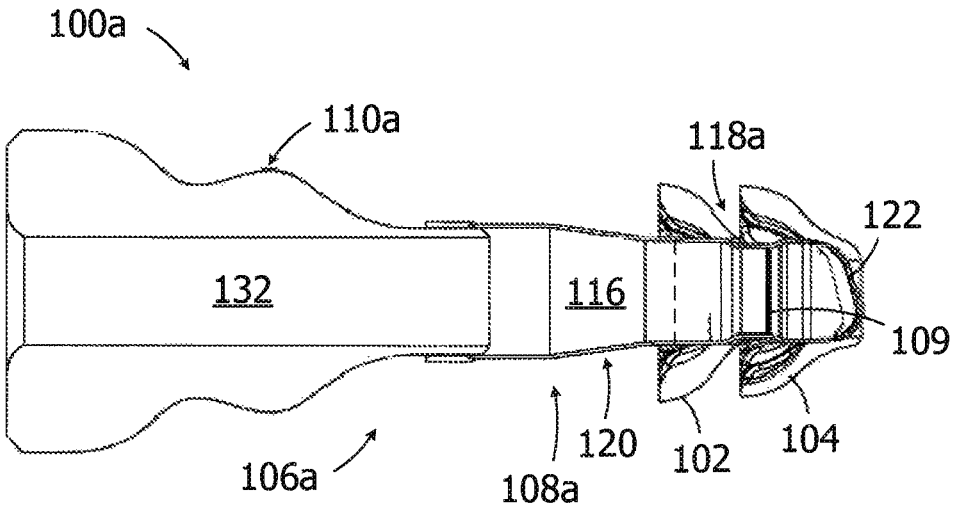
FIG. 28 is a side view of a portion of a hearing device seal module in accordance with one embodiment of a present invention.
Figure 29:
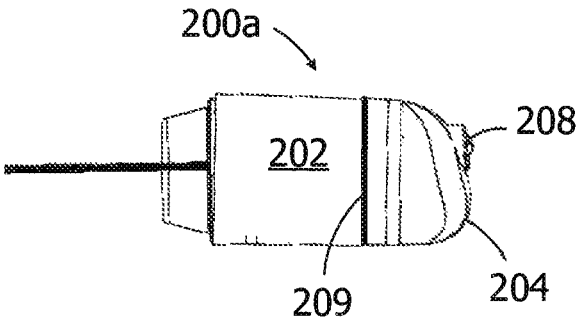
FIG. 29 is a side view of a portion of a hearing device core in accordance with one embodiment of a present invention.

As noted above with reference to FIGS. 23 and 24, one aspect of the hearing device assembly process is the alignment in the medial-lateral direction of the hearing device core 200 with the seal support region 118 so that the seals 102 and 104 will be accurately located on the core. To that end, in at least some implementations, the seal carrier 108 may be transparent or translucent and the seal carrier and hearing device core 200 may be provided with indicia that, when aligned with one another, indicate that the core is in the intended location in the medial-lateral direction. For example, and referring to FIGS. 28 and 29, the exemplary hearing device seal module **100*a* is similar to hearing device seal module 100 an similar elements are represented by similar reference numerals. For example, the hearing device seal module 100*a* includes seals 102 and 104 and an assembly apparatus 106*a* with a seal carrier 108*a* and a handle 110*a*. The seal carrier 108*a*** includes a marker ring 109 and the core 200*a* includes a marker ring 209. The respective locations of the marker rings 109 and 209 are such that the core 200*a* will be properly aligned with the seal support region 118*a* when the marker rings are aligned with one another. The markers will be visible by way of the space under the seal 104. Although the marker ring 109 is shown in context of a hearing device seal module without a seal carrier support, the marker ring may also be provided on a hearing device seal module with a seal carrier support (e.g., hearing device seal module 100).

One exemplary method (not shown) of securing one or more seals (e.g., seals 102 and 104) to the assembly apparatus 106 to form a hearing device seal module 100 involves supporting the tubular seal carrier 108 on a mandrel that has a contoured region at the medial end with a shape that corresponds to that of the seal support region medial end 162. The cross-sectional size and shape of the mandrel may correspond to that of the portion of the core 200 that will be aligned with the central portion 160 of the seal support region 118. As a result, when the mandrel is inserted into the seal carrier 108, the mandrel will stretch the seal support region central portion 160. The mandrel will also rest against the inner surface of the lateral portion 156 and medial portion 158. The seals 102 and 104 may then be positioned on the seal support region 118, and secured thereto with adhesive or any other suitable instrumentality. The mandrel may then be removed from the assembly apparatus seal carrier 108.

As noted above, one advantage associated with the present hearing device seal modules and methods is that they allow fitting facilities to store seal modules with a variety seal sizes, or size combinations, and to deploy them as needed. At the time of fitting, the module with the appropriately sized seals may be used to secure the seals to the core.

The hearing device seal module 100 may, for example, be provided as part of a seal module package 80. The module handle 110 may form part of the packaging for the core. To that end, and referring to FIGS. 30 and 31, the exemplary seal module package 80 includes a seal module 100 and a cover 402. The exemplary cover 402, which is configured to mate with the handle 110 to form an enclosure for the seals 102 and 104 and assembly apparatus 106, includes a wall 402 and the slots 404 that define a flexible latch 406 therebetween. The cover 402 may be translucent (as shown) or opaque. There may be slots 404 and a latch 406 on one or both sides of the cover 402. The latch(s) 406 are configured to mate with the latches 152 on the module handle 110. At the time of use, the cover 402 may simply be pulled off of the module handle 110.

The seal module package 80 may also be used to provide information about the seal module 100. For example, as noted above with reference to FIG. 9, indicia that identifies the respective sizes of the seals 102 and 104 may be provided, for example, on the surface of end wall 144 that faces the receptacle 128.

Figure 32:
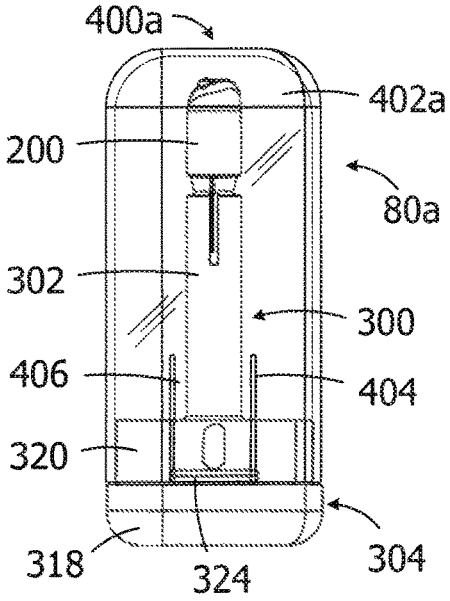
FIG. 32 is a front view of a core and plunger package in accordance with one embodiment of a present invention.

In at least some implementations, the hearing device core may be provided together with a plunger. The plunger may form part of the packaging for the core. To that end, and referring to FIGS. 32 and 33, the exemplary core and plunger package 80*a* includes a hearing device core 200, a plunger 300 and a cover 400*a*. The hearing device core 200 and plunger 300 are discussed above. The exemplary cover 400*a*, which is configured to mate with the plunger handle 304 to form an enclosure for the core 200 and the plunger rod 302, includes a wall 402*a* and the slots 404 that define a flexible latch 406 therebetween. The cover 402*a* may be translucent (as shown) or opaque. There may be slots 404 and a latch 406 on one or both sides of the cover 402*a*. The latch(s) 406 are configured to mate with the latches 324 on the plunger handle 304. At the time of use, the cover 402*a* may simply be pulled off of the plunger handle 304 so that the core 200 and plunger rod 302 may be inserted into the seal module 100 in the manner described above.

Although the inventions disclosed herein have been described in terms of the preferred embodiments above, numerous modifications and/or additions to the above-described preferred embodiments would be readily apparent to one skilled in the art. By way of example, but not limitation, the present hearing device seal modules may include only one seal, or may include more than two seals. The inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A hearing device seal module for use with a hearing device core, comprising:
   - a tubular seal carrier defining an inner surface and a lumen configured for passage of the hearing device core and including a resilient seal support region formed from resilient material and configured to receive the hearing device core;
   - a seal carrier support that abuts a portion of the tubular seal carrier inner surface and that is configured to hold at least a portion of the resilient seal support region open during an insertion of the hearing device core; and
   - a first seal secured to a first portion of the seal support region and extending outwardly therefrom.

2. A hearing device seal module for use with a hearing device core, comprising:
   - a tubular seal carrier defining a lumen configured for passage of the hearing device core and including a resilient seal support region formed from resilient material and configured to receive the hearing device core;
   - a seal carrier support, including a plurality of elongate members with respective medial and lateral portions, configured to hold at least a portion of the resilient seal support region open during an insertion of the hearing device core; and
   - a first seal secured to a first portion of the seal support region and extending outwardly therefrom.

3. The hearing device seal module claimed in claim 2, further comprising:
   - a handle secured to the respective lateral portions of the plurality of elongate members.

4. The hearing device seal module claimed in claim 3, wherein
   - the handle includes a support tube defining a lumen that is aligned with the tubular seal carrier lumen and a plurality of indentations configured to receive the plurality of elongate members.

5. The hearing device seal module claimed in claim 1, wherein
   - the seal carrier support includes a base portion and a tapered portion.

6. A hearing device seal module for use with a hearing device core, comprising:
   - a tubular seal carrier defining a lumen configured for passage of the hearing device core and including a resilient seal support region formed from resilient material and configured to receive the hearing device core, a connector region lateral of the seal support region and a weakened area between the connector region and the seal support region a seal carrier support configured to hold at least a portion of the resilient seal support region open during an insertion of the hearing device core; and a first seal secured to a first portion of the seal support region and extending outwardly therefrom.

7. The hearing device seal module claimed in claim 6, further comprising:

a handle secured to the tubular seal carrier connector region and to the seal carrier support at respective locations lateral of the weakened area such that the connector region and the seal carrier support will remain connected to the handle when the seal support region is disconnected from the connector region at the weakened area.

8. A hearing device seal module for use with a hearing device core, comprising:

a tubular seal carrier defining a medial-lateral axis and a lumen configured for passage of the hearing device core and including a resilient seal support region formed from resilient material, configured to receive the hearing device core, and including a first portion defining a first portion perimeter in a plane perpendicular to the medial-lateral axis and a second portion, lateral of the first portion, defining a second portion perimeter in a plane perpendicular to the medial-lateral axis that is less than the first portion perimeter when the resilient seal support region is in an unstressed state;

a seal carrier support configured to hold at least a portion of the resilient seal support region open during an insertion of the hearing device core; and a first seal on and secured to the first portion of the resilient seal support region and extending outwardly therefrom.

9. The hearing device seal module claimed in claim 8, wherein the resilient seal support region includes a third portion, lateral of the second portion, defining a third portion perimeter in a plane perpendicular to the medial-lateral axis that is greater than the second portion perimeter when the resilient seal support region is in an unstressed state; and the hearing device seal module further comprises a second seal, the second seal being located on the third portion of the resilient seal support region and extending outwardly therefrom.

10. The hearing device seal module claimed in claim 1, wherein the seal support region comprises an oval seal support region.

11. The hearing device seal module claimed in claim 1, wherein the seal support region includes a closed medial end with a sound aperture extending therethrough.

12. A hearing device seal module for use with a hearing device core, comprising:

a tubular seal carrier formed from resilient material, defining a medial-lateral axis, a medial end and an oval lumen configured for passage of the hearing device core, and including an oval connector region and an oval seal support region with a weakened area therebetween, the seal support region having a sound aperture at the medial end that is not centered on the medial-lateral axis, a first portion defining a first portion perimeter in a plane perpendicular to the medial-lateral axis, a first portion major dimension and a first portion minor dimension, a second portion, lateral of the first portion, defining a second portion perimeter in a plane perpendicular to the medial-lateral axis that is less than the first portion perimeter when the seal support region is in an unstressed state, a second portion major dimension that is less than the first portion major dimension and a second portion minor dimension that is less than the first portion minor dimension, and a third portion, lateral of the second portion, defining a third portion perimeter in a plane perpendicular to the medial-lateral axis that is greater than the second portion perimeter when the seal support region is in an unstressed state, a third portion major dimension that is greater than the second portion major dimension and a third portion minor dimension that is greater than the second portion minor dimension;

a first seal secured to the first portion of the seal support region and extending outwardly therefrom;

a second seal secured to the third portion of the seal support region and extending outwardly therefrom; and a handle, defining an oval lumen configured for passage of the hearing device core and including indicia indicative of the location of the tubular seal carrier sound aperture, secured to the tubular seal carrier connector region at a location lateral of the weakened area such that the connector region will remain connected to the handle when the seal support region is disconnected from the connector region at the weakened area.

13. A hearing device system, comprising:

a first hearing device seal module, for use with a hearing device core, including a tubular seal carrier defining a lumen configured for passage of the hearing device core and including a resilient seal support region formed from resilient material and configured to receive the hearing device core, a seal carrier support configured to hold at least a portion of the resilient seal support region open during an insertion of the hearing device core, and a first seal secured to a first portion of the seal support region and extending outwardly therefrom; and a plunger configured to be inserted into the tubular seal carrier and to push a hearing device core through the seal carrier support.

14. The hearing device system claimed in claim 13, wherein the plunger and the first hearing device seal module are respectively configured such that the plunger cannot be completely inserted into the first hearing device seal module unless the plunger is in a predetermined orientation relative to the first hearing device seal module.

15. The hearing device system claimed in claim 13, wherein the tubular seal carrier defines a medial end;

the tubular seal carrier includes a connector region lateral of the seal support region and a weakened area between the connector region and the seal support region; and the plunger and the first hearing device seal module are respectively configured such that the connector region and the seal support region will disconnect from one another at the weakened area as the hearing device core approaches the medial end of the tubular seal carrier.

16. The hearing device system claimed in claim 13, wherein the plunger defines a medial end and includes a connector configured to secure the hearing device core to the medial end of the plunger.

17. The hearing device system claimed in claim 13, further comprising:

a second hearing device seal module as claimed in claim 1;

wherein the first and second hearing device seal modules do not have the same sized seals.

* * * * *